US009976262B2

(12) United States Patent
Kuo et al.

(10) Patent No.: US 9,976,262 B2
(45) **Date of Patent: *May 22, 2018**

(54) PULP MOLDING MACHINE, PULP MOLDING PROCESS AND PAPER-SHAPED ARTICLE MADE THEREBY

(71) Applicant: GOLDEN ARROW PRINTING CO., LTD., New Taipei (TW)

(72) Inventors: Chien-Kuan Kuo, New Taipei (TW); Chun-Huang Huang, New Taipei (TW)

(73) Assignee: GOLDEN ARROW PAINTING CO., LTD., New Taipei (TW)

( * ) Notice: Subject to any disclaimer, the term of this patent is extended or adjusted under 35 U.S.C. 154(b) by 97 days.

This patent is subject to a terminal disclaimer.

(21) Appl. No.: 14/966,387

(22) Filed: Dec. 11, 2015

(65) Prior Publication Data

US 2016/0168801 A1 Jun. 16, 2016

Related U.S. Application Data

(60) Provisional application No. 62/091,194, filed on Dec. 12, 2014, provisional application No. 62/091,203, filed on Dec. 12, 2014.

(30) Foreign Application Priority Data

Oct. 23, 2015 (TW) ..... 104217053 U
Nov. 6, 2015 (TW) ..... 104217868 U
Nov. 10, 2015 (TW) ..... 104137038 A

(51) Int. Cl.
*D21J 3/00* (2006.01)

(52) U.S. Cl.
CPC ..... *D21J 3/00* (2013.01)

(58) Field of Classification Search
CPC ..... D21J 3/00; D21J 7/00; D21J 3/10; B29C 51/10; B29C 51/28; B29C 51/30;
(Continued)

(56) References Cited

U.S. PATENT DOCUMENTS 3,287,208 A * 11/1966 Peppler ..... D21J 5/00 162/227
6,451,235 B1 * 9/2002 Owens ..... D21J 3/00 162/218

(Continued)

FOREIGN PATENT DOCUMENTS

CN 103015273 A * 4/2013 ..... D21J 5/00
EP 2937462 A1 * 10/2015 ..... D21J 5/00

(Continued)

*Primary Examiner* — Jose A Fortuna
(74) *Attorney, Agent, or Firm* — Osha Liang LLP

(57) ABSTRACT

A pulp molding machine, a pulp molding process and a paper-shaped article made thereby are provided. The pulp molding machine comprises a pulp-dredging stage, a first pre-compression forming sub-stage, a second pre-compression stage, a compression thermo-forming stage and an edge-cutting stage. The pulp molding process comprises the steps of a pulp-dredging step, a first pre-compression forming step, a second pre-compression forming step, a compression thermo-forming step and an edge-cutting step. The pulp molding machine the pulp molding process can drain off water or vapor from a wet pulp more efficiently and shorten the cycle time of the pulp molding process due to the extra pre-compression sub-stage. The paper-shaped article made thereby has a greater smoothness and structural strength than conventional paper-shaped product.

14 Claims, 4 Drawing Sheets

(58) Field of Classification Search
CPC ..... B29C 2791/006; B29C 2791/007; B29C 243/006; B29C 43/361; B22F 2207/17; B22F 3/10; B22F 3/11; B22F 3/1146; B22F 5/007; Y10T 428/31989; C22C 1/08
See application file for complete search history.

(56) References Cited

U.S. PATENT DOCUMENTS

| | | | | |
|---|---|---|---|---|
| 6,706,151 | B1 * | 3/2004 | Oosthuizen | D21J 5/00 162/116 |
| 6,752,910 | B2 * | 6/2004 | Sato | D21J 3/10 162/396 |
| 7,591,927 | B2 * | 9/2009 | Kim | B31D 5/02 162/147 |
| 8,795,474 | B2 * | 8/2014 | Lang | D21J 3/00 162/382 |
| 9,149,948 | B2 * | 10/2015 | Kuo | B25J 9/0084 |
| 9,556,563 | B1 * | 1/2017 | Yang | D21J 3/10 |
| 9,650,746 | B2 * | 5/2017 | Kuo | D21H 21/18 |
| 9,663,898 | B2 * | 5/2017 | Zhang | D21F 9/04 |
| 2003/0111201 | A1 * | 6/2003 | Sato | D21J 3/10 162/382 |
| 2004/0045690 | A1 * | 3/2004 | Eto | D21J 3/10 162/225 |
| 2007/0227680 | A1 * | 10/2007 | Kim | B31D 5/02 162/218 |
| 2013/0228301 | A1 * | 9/2013 | Lang | D21J 3/00 162/231 |
| 2014/0041498 | A1 * | 2/2014 | Kuo | B25J 9/0084 83/152 |
| 2015/0007954 | A1 * | 1/2015 | Huang | B65D 1/225 162/111 |
| 2015/0292154 | A1 * | 10/2015 | Zheng | D21J 5/00 162/226 |
| 2016/0010285 | A1 * | 1/2016 | Kuo | D21J 3/00 162/219 |
| 2016/0090694 | A1 * | 3/2016 | Zhang | D21J 3/00 162/217 |
| 2016/0168793 | A1 * | 6/2016 | Kuo | D21J 3/00 162/227 |
| 2016/0168800 | A1 * | 6/2016 | Kuo | D21J 3/00 162/218 |
| 2016/0168801 | A1 * | 6/2016 | Kuo | D21J 3/00 162/194 |
| 2016/0244917 | A1 * | 8/2016 | Kuo | D21J 3/00 |
| 2016/0362845 | A1 * | 12/2016 | Kuo | D21H 21/18 |
| 2016/0368235 | A1 * | 12/2016 | Kuo | B31B 43/00 |

FOREIGN PATENT DOCUMENTS

| | | | | |
|---|---|---|---|---|
| GB | 1066322 | A * | 4/1967 | B01D 27/005 |
| GB | 2413301 | A * | 10/2005 | D21J 1/06 |
| WO | WO-0058557 | A1 * | 10/2000 | D21J 5/00 |
| WO | WO-2005012640 | A1 * | 2/2005 | D21J 7/00 |

* cited by examiner

PULP MOLDING MACHINE, PULP MOLDING PROCESS AND PAPER-SHAPED ARTICLE MADE THEREBY

CROSS-REFERENCES

This application claims the benefit of U.S. Provisional Patent Application No. 62/091,203 filed on Dec. 12, 2014, U.S. Provisional Patent Application No. 62/091,194 filed on Dec. 12, 2014, Taiwan application serial NO. 104217868, filed on Nov. 6, 2015, Taiwan application serial NO. 104137038, filed on Nov. 10, 2015, and Taiwan application serial NO. 104217053, filed on Oct. 23, 2015. The entirety of each of the above-mentioned patent applications is hereby incorporated by reference herein and made a part of this specification.

FIELD OF THE INVENTION

The present invention relates to a pulp molding technology, and more particularly to a pulp molding machine and a pulp molding process for improving the production efficiency, and also particularly to a paper-shaped article made by the pulp molding machine and the pulp molding process.

BACKGROUND OF THE INVENTION

Traditionally, a sponge or foam used in the inner packaging or outer packaging of a product for protection and shockproof is gradually replaced by a pulp molding article molded by pulp. The pulp molding article (or paper-shaped product) uses pulp as raw material and dredged the pulp, compressed the pulp by the molds for forming the same. The pulp molding article can be recycled and remanufactured so as to comply with the trend of energy conservation and carbon reduction.

A conventional pulp molding machine for forming a paper shape product is divided into two separate operation machine, including a molding machine and a shaping machine which are not linked to each other. The automatic production line cannot be maintained in a consistent continuous operation, so that a semi-finished product must rely on artificial means to deliver between the molding machine and the shaping machine. Moreover, the molding machine for forming a paper shape product comprises a pulp-dredging stage and a thermo-forming stage. In the pulp-dredging stage, a plurality of molds are used for dredging a wet pulp from a paper slurry tank. During the thermo-forming stage, the plurality of molds are compressed and heated so as to decrease the humidity of the wet pulp and obtain the semi-finished product. Thereafter, the shaping machine is used for cutting superfluous edges of the semi-finished product to form the pulp molding article.

In addition, the conventional pulp molding machine reduces the moisture contained in the wet pulp only by performing the thermo-forming stage at once. After the pulp-dredging stage, the wet pulp in the molds contains a high proportion of the moisture content (more than 50% of the overall weight). In the following molding process, it always takes a very long cycle time to drain off water or vapor from the wet pulp compressed between the molds, such as the thermo-forming stage takes about 160 seconds to drain off water or vapor from the wet pulp for obtaining the semi-finished product/the pulp molding article. This invokes a low production efficiency in mass. Moreover, it is likely to crush the structure of the pulp molding article during the thermo-forming stage if a larger compression force is applied on the wet pulp at once. Accordingly, due to the thermo-forming stage is processed at once, the conventional pulp molding machine leads to a lower production efficiency in mass and easily crushes the structure of the pulp molding article.

Besides, the conventional pulp molding machine employs conventional aluminum mold for dredging the slurry and thermo-forming. The conventional aluminum mold is disposed to a mesh on a surface of the conventional aluminum mold for holding the slurry thereon. The mesh need to be replaced frequently. Also, the traces of the mesh will be imprinted on the surface of the semi-finished product/the pulp molding article.

Therefore, it is necessary to provide a pulp molding machine, a pulp molding process and a paper-shaped article to solve the above problems, such as shortening the production time of the conventional pulp molding process and maintaining the integrity of the semi-finished product/the pulp molding article.

SUMMARY OF THE INVENTION

In order to solve the aforementioned drawbacks of the prior art, the main object of the present invention is to provide a pulp molding machine for shortening the production time of forming the semi-finished/the pulp molding article. The pulp molding machine of the present invention performs a pre-compression sub-stage to drain off water or vapor in advance from the wet pulp with high water content between a first upper mold and a first lower mold during a pulp-dredging stage. This can reduce the water or vapor content in the wet pulp before performing a compression thermo-forming stage for preventing the crushing of the structure of the pulp molding article during the compression thermo-forming stage if a larger compression force and thermal is applied on the wet pulp rapidly. Thus, pulp fibers within the wet pulp become denser, and then the wet pulp is thermo-compressed by and between a second upper mold and a second lower mold for shortening the production time of the compression thermo-forming stage and improving the production efficiency in mass.

Another main object of the present invention is to provide a pulp molding process for increasing a drying rate of the dredged wet pulp, and further for improving the production efficiency in mass. With performing the pre-compression sub-stage to drain off water or vapor prior to the compression thermo-forming stage, the dryness of the wet pulp is increased. Also, the drying time consumed by the compression thermo-forming stage will be significantly reduced.

Yet another object of the present invention is to provide a paper-shaped article made by the pulp molding machine and the pulp molding process for enhancing the overall structural strength of the paper-shaped article. In addition, the paper-shaped article not only has good structural strength but also presents two outermost surfaces with higher smoothness thereon for looking good.

For achieving the above-mentioned technical solution, the present invention proposes a pulp molding machine, comprising:

a machine frame body;

a pulp-dredging stage disposed on the machine frame body, comprising a paper slurry tank, a first upper mold, a first lower mold and a first driving device, wherein a wet pulp is dredged up by the first lower mold from the paper slurry tank, and then the dredged wet pulp is applied a first pre-compression forming sub-stage by and between the first upper mold and the first lower mold, to form a first semi-finished product;

a second pre-compression stage disposed, adjacent to the pulp-dredging stage, on the machine frame body, comprising a second upper mold, a second lower mold and a second driving device, the first upper mold is moved by the first driving device from the first pre-compression forming sub-stage of the pulp-dredging stage to the second pre-compression stage, to convey the first semi-finished product to the second pre-compression stage, the first semi-finished product is compressed by and between the second upper mold and the second lower mold, to form a second semi-finished product;

a compression thermo-forming stage disposed, adjacent to the second pre-compression stage, on the machine frame body, comprising a third upper mold, a third lower mold and a third driving device, the second upper mold is moved by the second driving device from the second pre-compression stage to the compression thermo-forming stage, to convey the second semi-finished product to the compression thermo-forming stage, the second semi-finished product is thermo-compressed by and between the third upper mold and the third lower mold, to form a third semi-finished product; and an edge-cutting stage comprising a chopper, and disposed on the machine frame body, adjacent to the compression thermo-forming stage, the third upper mold is moved by the third driving device from the compression thermo-forming stage to the edge-cutting stage, to convey the third semi-finished product to the edge-cutting stage, the edge-cutting stage make the chopper for cutting superfluous edges of the second semi-finished product to form a finished product.

In the pulp molding machine described above, when the first upper mold is moved downward in a matching manner close to the first lower mold, a first molding gap formed between the first upper mold and the first lower mold is in a range between 1 mm~5 mm.

In the pulp molding machine described above, when the second upper mold is moved downward in a matching manner close to the second lower mold, a second molding gap formed between the second upper mold and the second lower mold is less than or equal to 2 mm, and the second molding gap is less than the first molding gap.

In the pulp molding machine described above, when the third upper mold is moved downward in a matching manner close to the third lower mold, a third molding gap formed between the third upper mold and the third lower mold is less than or equal to 2 mm, and the third molding gap is less than the first molding gap.

In the pulp molding machine described above, the first upper mold, the second upper mold and the third upper mold are convex shaped molds, and the first lower mold, the second lower mold and the third lower mold are concave shaped molds.

In the pulp molding machine described above, the first upper mold, the first lower mold, the second upper mold, the second lower mold, the third upper mold and the third lower mold are formed with at least one through hole respectively therein, for respectively releasing out water or vapor from the dredged wet pulp, the first semi-finished product, the second semi-finished product and the third semi-finished product on the corresponding molds.

In the pulp molding machine described above, the pulp molding machine further comprises at least one suctioning device respectively liquid-communicated with the respective through holes within the first upper mold, the first lower mold, the second upper mold, the second lower mold, the third upper mold and the third lower mold for drawing out the water or vapor.

In the pulp molding machine described above, the pulp molding machine further comprises at least one heater, which is disposed to either the second upper mold and the third upper mold or the second lower mold and the third lower mold, for respectively heating the corresponding molds to accumulatedly dry the first semi-finished product and the third semi-finished product thereon.

In the pulp molding machine described above, the first upper mold and the first lower mold are made of aluminum, the first lower mold further comprises a double layered first mesh disposed on an inner surface thereof for holding the wet pulp on the first mesh.

In the pulp molding machine described above, the second lower mold is made of a porous metal material selected from the group consisting of sintered copper, stainless steel, and nickel alloy, and the second upper mold is made of aluminum, and a porosity of the porous metal material is 10%-25%.

In the pulp molding machine described above, the third upper mold and the third lower mold are made of aluminum, the third upper mold further comprises a third upper mesh disposed under a bottom of a protrusion part of the third upper mold, and the third lower mold further comprises a third lower mesh disposed on a top edge of a groove of the third lower mold.

In the pulp molding machine described above, the third lower mold is made of a porous metal material selected from the group consisting of sintered copper, stainless steel, and nickel alloy, and the third upper mold is made of aluminum, and a porosity of the porous metal material is 10%-25%.

In the pulp molding machine described above, the pulp molding machine further comprises a reversible pulp-dredging device disposed to the first lower mold, for driving the first lower mold to rotate 180 degrees.

In the pulp molding machine described above, the pulp molding machine further comprises a drawing element disposed to the first lower mold for drawing and attaching the wet pulp on a surface of the first lower mold in the paper slurry tank after the first lower mold rotates in 180 degrees.

For achieving the above-mentioned technical solution, the present invention further proposes reversible pulp-dredging device for using in the pulp molding machine, wherein the pulp molding machine comprises a machine frame body including a paper slurry tank, a first upper mold, and a first lower mold, the first lower mold comprises a dredging surface, the reversible pulp-dredging device is disposed to the first lower mold and comprises:

an inversion frame comprising a rotating shaft and an inversion driving element, the first lower mold is disposed to the inversion frame, for driving the first lower mold to rotate 180 degrees, so that the dredging surface of the first lower mold is downwardly for dredging paper slurry from the paper slurry tank;

a pair of elevating elements respectively installed onto both sidewalls of the paper slurry tank, one end of a rotation axis of the rotating shaft is configured with the elevating elements, and another end of the rotating shaft is penetrated into the first lower mold for driving the inversion frame with the first lower mold dipping into the paper slurry or resurfacing from the paper slurry; and a drawing element disposed to the first lower mold and connected to the inversion frame for suctioning the paper slurry from the paper slurry tank when the dredging surface of the first lower mold is downwardly for dredging the paper slurry, so that the paper slurry is attached on the dredging surface of the first lower mold.

For achieving the above-mentioned technical solution, the present invention further proposes a paper-shaped article made by the pulp molding machine, comprising:

a middle fiber layer;

a smooth inner layer formed on one surface of the middle fiber layer, which has a surface smoothness greater than or equal to 3 seconds according to Bekk Smoothness measurement; and a smooth outer layer formed on another surface of the middle fiber layer, which has a surface smoothness greater than or equal to 3 seconds according to Bekk Smoothness measurement;

wherein the middle fiber layer has a lower smoothness than either the outer layer or the inner layer.

For achieving the above-mentioned technical solution, the present invention further proposes a pulp molding process using the pulp molding machine, comprising:

a pulp-dredging step applied to dredge up a slurry by a first lower mold of the pulp molding machine from a paper slurry tank for forming a wet pulp;

a first pre-compression forming step applied on the dredged wet pulp which is compressed by and between a first upper mold and the first lower mold of the pulp molding machine, so as to form a first semi-finished product;

a second pre-compression forming step applied on the first semi-finished product which is compressed by and between a second upper mold and a second lower mold of the pulp molding machine, so as to form a second semi-finished product;

a compression thermo-forming step applied on the second semi-finished product which is thermo-compressed by and between a third upper mold and a third lower mold of the pulp molding machine, so as to form a third semi-finished product; and an edge-cutting step applied on the third semi-finished product by a chopper to form a paper-shaped article.

In the pulp molding process described above, the first upper mold, the second upper mold and the third upper mold are moved by at least one driving device to convey the first semi-finished product, the second semi-finished product, and the third semi-finished product which are being suctioned by the first upper mold, the second upper mold and the third upper mold, respectively.

In the pulp molding process described above, a heating step is further applied to heat the first semi-finished product located above on the second lower mold in the second pre-compression forming step, and a heating step is further applied to heat the second semi-finished product located above on the third lower mold in the compression thermo-forming step.

In the pulp molding process described above, a cycle time of the pulp-dredging step and the first pre-compression forming step is below 10 seconds, a cycle time of the second pre-compression forming step is between 30~50 seconds, and a cycle time of the compression thermo-forming step is between 30~50 seconds.

DESCRIPTION OF THE DRAWINGS

FIG. 3-1 depicts a schematically stereographic view of a third upper mold according to a preferred embodiment of the present invention;

FIG. 3-2 depicts a cross-sectional view of the third upper mold and the third lower mold in a matching manner according to a preferred embodiment of the present invention;

DETAILED DESCRIPTION OF THE PREFERRED EMBODIMENTS

Figure 1:
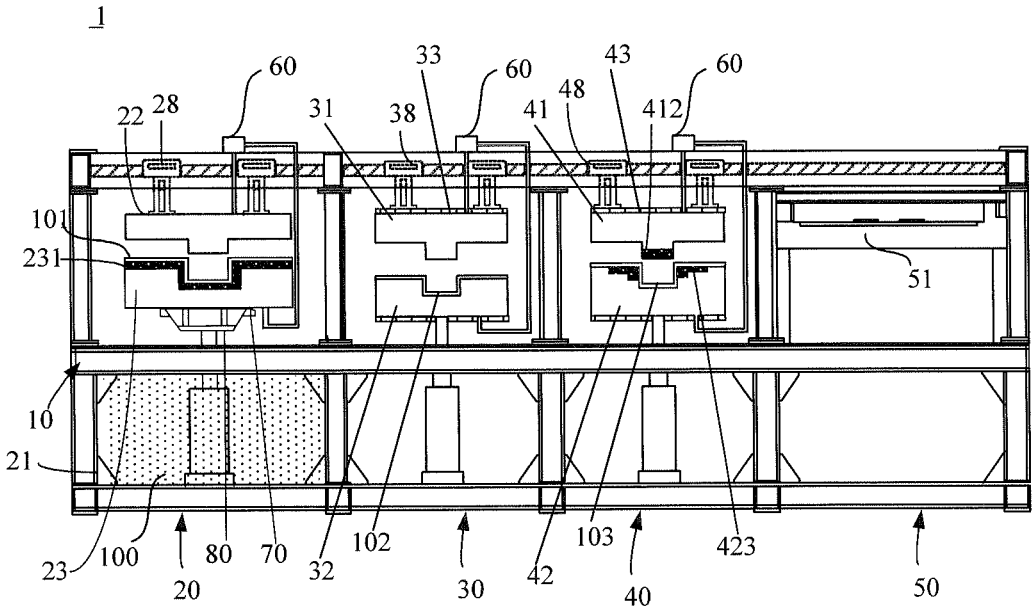
FIG. 1 depicts a schematic view of a pulp molding machine according to a preferred embodiment of the present invention.

This description of the exemplary embodiments is intended to be read in connection with the accompanying drawings, which are to be considered part of the entire written description. In the description, terms such as "lower," "upper," "horizontal," "vertical,", "above," "below," "up," "down," "top", and "bottom" as well as derivatives thereof should be construed to refer to the orientation as then described or as shown in the drawing under discussion. These terms are for convenience of description and do not require that the apparatus be constructed or operated in a particular orientation, and do not limit the scope of the invention.

Please refer to FIG. 1, which is a schematic view of a pulp molding machine 1 according to a preferred embodiment of the present invention. The pulp molding machine 1 principally comprises a machine frame body 10, a pulp-dredging stage 20, a second pre-compression stage 30, a compression thermo-forming stage 40 and an edge-cutting stage 50.

The pulp-dredging stage 20 is disposed on the machine frame body 10, and comprises a paper slurry tank 21, a first upper mold 22, a first lower mold 23 and a first driving device 28. The paper slurry tank 21 contains paper slurry 100. The first lower mold 23 collects and dredges the paper slurry 100 up from the paper slurry tank 21 to form a wet pulp located inside the first lower mold 23. Then, the dredged wet pulp is pre-compressed by and between the first upper mold 22 and the first lower mold 23, so as to form a first semi-finished product 101 in a predetermined shape.

The pulp-dredging stage 20 and a first pre-compression forming sub-stage are performed in the same working stage applied in the pulp molding machine. That is to say, the pulp-dredging stage 20 which is applied to collect/dredge up a paper slurry 100 from a paper slurry tank 21 and further including the first pre-compression forming sub-stage which is applied on the dredged wet pulp by and between the first upper mold 22 and the first lower mold 23, both kept in a first molding gap (not shown) therebetween.

The second pre-compression stage 30 disposed, adjacent to the pulp-dredging stage 20, on the machine frame body 10, comprises a second upper mold 31, a second lower mold 32 and a second driving device 38. The first upper mold 22 is moved by the first driving device 28 from the first pre-compression forming sub-stage of the pulp-dredging stage 20 to the second pre-compression stage 30, accompanying with conveying the first semi-finished product 101 to the second pre-compression stage 30. Then, the first semi-finished product 101 is applied a compression force by and between the second upper mold 31 and the second lower mold 32, to form a second semi-finished product 102 in a predetermined shape.

The compression thermo-forming stage 40 disposed, adjacent to the second pre-compression stage 30, on the machine frame body 10, comprises a third upper mold 41, a third lower mold 42 and a third driving device 48. The second upper mold 31 is moved by the second driving device 38 from the second pre-compression stage 30 to the compression thermo-forming stage 40, accompanying with conveying the second semi-finished product 102 to the compression thermo-forming stage 40. Then, the second semi-finished product 102 is thermo-compressed by and between the third upper mold 41 and the third lower mold 42, so as to form a third semi-finished product 103 in a predetermined shape.

The edge-cutting stage 50 is disposed, adjacent to the compression thermo-forming stage 40, on the machine frame body 10. The third upper mold is moved by the third driving device 48 from the compression thermo-forming stage 40 to the edge-cutting stage 50, to convey the third semi-finished product 103 to the edge-cutting stage 50. The edge-cutting stage 50 comprises a chopper 51 for cutting superfluous edges of the third semi-finished product 103 to form a paper-shaped finished article 104 (shown in FIG. 7).

The machine frame body 10 is constructed as a rack body, fitted with two parallel extending guide rails, and having the first driving device 28, the second driving device 38 and the third driving device 48 disposed on an upper side of the machine frame body 10. The first driving device 28, the second driving device 38 and the third driving device 48 can be selected from automatic arms, sliding racks, lead screws driven by motors, or the combination thereof, which is a conventional device and technology and will not repeated herein.

In more detail, in this embodiment of the present invention, the first driving device 28 is disposed to the pulp-dredging stage 20, for controlling the first lower mold 23 dredging the paper slurry 100 from the paper slurry tank 21 to form the wet pulp.

Besides, the first lower mold 23 further comprises a vacuum suctioning device 60 for collecting/dredging up the paper slurry 100 from the paper slurry tank 21 to distribute over a surface of the first lower mold 23. A period time of the first lower mold 23 staying in the paper slurry tank 21 for dredging the paper slurry 100 is about 3.5 seconds. Thereafter, the first lower mold 23 is moved away from the paper slurry tank 21 to finish the pulp-dredging process where the paper slurry 100 dredged up from the paper slurry tank 21 forms the wet pulp positioned on the first lower mold 23. Then, the wet pulp is lightly-compressed by and between mutually clamping of the first lower mold 23 and the first upper mold 22, for performing the first pre-compression forming sub-process toward the dredged wet pulp. The pre-compression forming sub-process is successfully performed for about 3 seconds. In addition, when the first upper mold 22 is moved downward in a matching manner close to the first lower mold 23, a first molding gap formed between the first upper mold 22 and the first lower mold 23 is in a range between 1 mm~5 mm, such as 3 mm is optimal but is not limited thereto. By the pre-compression forming sub-process, the wet pulp made of the paper slurry 100 is further shaped to form the first semi-finished product 101. A dryness of the first semi-finished product 101 is 10%-50%, such as 33% is optimal but is not limited thereto.

In this embodiment of the present invention, the first upper mold 22 and the first lower mold 23 are formed with at least one through hole, respectively, for releasing out water or vapor from the dredged wet pulp. The through holes are distributed over inner surfaces of the first upper mold 22 and the first lower mold 23 and extended through the first upper mold 22 and the first lower mold 23, respectively. Thus, the water or vapor drained off from the wet pulp can be released out via the through holes. Moreover, the vacuum suctioning device 60 is liquid-communicated with the respective through holes of the first upper mold 22 and the first lower mold 23 for suctioning out the water or vapor. The vacuum suctioning device 60 is implemented as a vacuum pump for drawing out the water or vapor within the respective molds 22, 23, through the through holes, to release the water or vapor while the wet pulp is compressed.

In this embodiment of the present invention, the first upper mold 22 is a convex shaped mold. That is to say, a protrusion portion is formed on the central portion of the first upper mold 22. The first lower mold 23 is a concave shaped mold structurally corresponding to the first upper mold 22. In different embodiment of the present invention, the first upper mold 22 is a concave shaped mold, and the first lower mold 23 is a convex shaped mold structurally corresponding to the first upper mold 22.

The first upper mold 22 and the first lower mold 23 both are made of aluminum. The first upper mold 22 comprises a first inner surface and a first mesh 231 disposed on the first inner surface thereof. The first mesh 231 has a double layered mesh structure which comprises a first inner mesh and a first outer mesh. A mesh count of the first outer mesh is greater than a mesh count of the first outer mesh, and thereby the wet pulp is held on the first mesh 231 to avoid the wet pulp from being inhaled into and blocking the through holes, when the vacuum suctioning device 60 draws out the water or vapor from the wet pulp through the through holes. Also, the first mesh 231 can accelerate the discharge of the water or vapor released from the wet pulp while the wet pulp is compressed by and between the first upper mold 22 and the first lower mold 23.

The through holes are formed on the corresponding mold by at least one machining process, including, for example, a wire-cutting, a laser machining, a grinding, an electrical discharge machining processes and so on.

After the pulp-dredging process including the first pre-compression forming sub-process, the first upper mold 22 is moved by the first driving device 28 (such as an automatic arm or a sliding rack of the production line frame) of the machine frame body 10, accompanying with conveying the first semi-finished product 101 which is being suctioned by the first upper mold 22, alone a horizontal and/or vertical directions in turn or together, from the pulp-dredging stage 20 to the second pre-compression stage 30. The first upper mold 22 is moved downward to a predetermined position of the second pre-compression stage 30 and delivers the first semi-finished product 101 to the second lower molds 32 and stops suction the first semi-finished product 101. Thereafter, the first upper mold 22 is moved back to a predetermined position of the pulp-dredging stage 20.

Next, the first semi-finished product 101 is thermo-compressed by and between the second upper mold 31 and the second lower mold 32. The wet pulp molding machine 1 further comprises at least one heater 33 (such as a heating plate/pipe), which is attached or disposed to either the second upper mold 31 or the second lower mold 32, for respectively heating the corresponding molds to accumulatedly dry the first semi-finished product 101 located thereon. Thus, the first semi-finished product 101 is thermo-compressed and shaped by and between the second upper mold 31 and the second lower mold 32 to form a second semi-finished product 102. In the second pre-compression stage 30, a temperature of the heater 33 is controlled in a range of 60° C. to 80°, and 70° C. is optimal but is not limited thereto. When the second upper mold 31 is moved downward in a matching manner close to the second lower mold 32, a second molding gap formed between the second upper mold 31 and the second lower mold 32 is less than or equal to 2 mm, 1.2 mm is preferably, and the second molding gap is less than the first molding gap. A dryness of the second semi-finished product 102 is in 58%-70%.

For the same structure as the first upper mold 22 and the first lower mold 23 mentioned above, referring to FIG. 1 and FIG. 2, the second upper mold 31 and the second lower mold 32 comprise at least one through hole 34, respectively, for releasing out water or vapor from the first semi-finished product 101. The through holes 34 are distributed over inner surfaces of the second upper mold 31 and the second lower mold 32, through the second upper mold 31 and the second lower mold 32, respectively. Thus, the water or vapor drained off from the wet pulp can be released out via the through holes 34. Besides, the vacuum suctioning device 60 is respectively liquid-communicated with the respective through holes 34 of the second upper mold 31 and the second lower mold 32, for drawing out the water or vapor. The vacuum suctioning device 60 is a vacuum pump for suctioning out the water or vapor within the second upper mold 31 and the second lower mold 32, through the through holes 34.

The through holes are formed on the corresponding mold by at least one machining process, including, for example, a wire-cutting, a laser machining, a grinding, an electrical discharge machining processes and so on. In different embodiments of the present invention, the through holes 34 are formed integrally with the corresponding mold by a metallic casting/sintering process.

In the embodiment of the present invention, referring to FIG. 1, the second upper mold 31 and the second lower mold 32 are made of aluminum/any other metal having a higher smoothness on its molding surface. The second upper mold 31 is a convex shaped mold. Namely, a protrusion portion is formed on a central portion of the second upper mold 31. The second lower mold 32 is a concave shaped mold structurally corresponding to the second upper mold 31. Namely, a groove 321 is formed on a central portion of the second lower mold 32. In other embodiment of the present invention, the second upper mold 31 further comprises a second upper mesh disposed on a surface at an end of the protrusion portion of the second upper mold 31, and the second lower mold 32 further comprises a second lower mesh disposed on a bottom of the groove 321 of the second lower mold 32, except that side edges of the bottom of the groove 321 are formed with smooth surfaces. The second lower mesh is a double layered mesh structure which comprises a second inner lower mesh and a second outer upper mesh. A mesh count of the second outer upper mesh is greater than a mesh count of the second inner lower mesh. Thus, a space between the first semi-finished product 101 and the second lower mold 32 is broadened for increasing the efficiency of suctioning out the water or vapor from the first semi-finished product 101 and further for holding the first semi-finished product 101 on the second lower mesh. Meanwhile, as the vacuum suctioning device 60 draws out the water or vapor contained in the first semi-finished product 101, through the through holes 34, the first semi-finished product 101 can be held on the second lower mold 32 to avoid the first semi-finished product 101 from being inhaled into and blocking the through holes 34, and to prevent the first semi-finished product 101 from attaching to the second lower mold 32 upon mold stripping.

Figure 2:
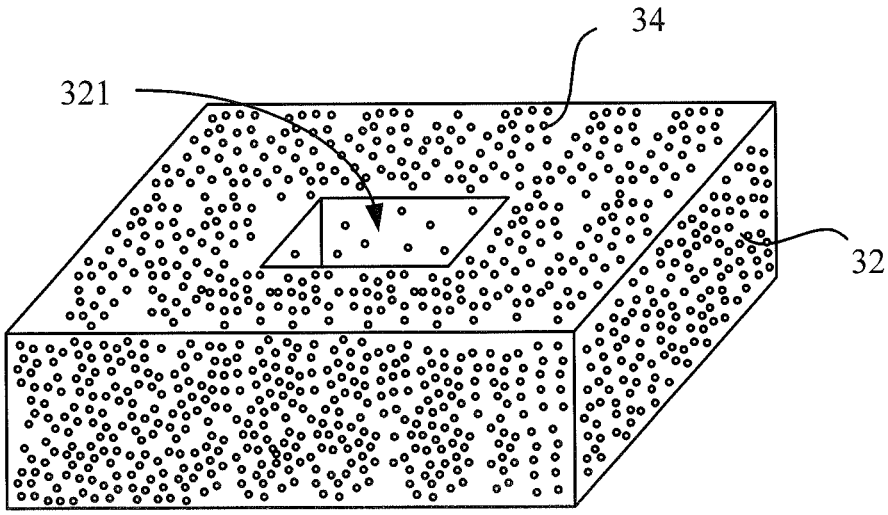
FIG. 2 is depicts a schematically stereographic view of a second lower mold or/and a third lower mold used for the pulp molding machine according to a preferred embodiment of the present invention.

In other different embodiment of the present invention, referring to FIG. 2, the second lower mold 32 can be made of the other porous metal material selected from the group consisting of sintered copper, stainless steel and nickel alloy having a thermal conductivity greater than 50 W/mK, and the second upper mold 31 is made of aluminum/any other metal having a higher smoothness on its molding surface. Preferably, the second lower mold 32 is a sintered copper mold which is constructed by a plurality of cooper particles, the particles of the sintered cooper has an average diameter of 2-20 μm. Also, the second lower mold 32 can be a sintered copper mold having a porosity of the porous metal material 10%-25%. Because the sintered copper mold is constructed by a plurality of particles, at least one pore is therefore formed within the sintered copper mold, so that the second lower mesh (such as the first mesh described in the first lower mold 23) is no longer necessary, a mesh print on a product can also be eliminated, thereby solving drawbacks of the prior art of the mesh print imprinted on the first semi-finished product 101/second semi-finished product 102 or the paper-shaped finished article 104.

Then, the second upper mold 31 is moved by the second driving device 38 (such as an automatic arm or a sliding rack of the production line frame), from the second pre-compression forming stage 30 to the compression thermo-forming stage 40, accompanying with conveying the second semi-finished product 102 which is being suctioned by the second upper mold 31 to the compression thermo-forming stage 40. The second upper mold 31 is moved downward to a predetermined position of the compression thermo-forming stage 40 and delivers the second semi-finished product 102 to the third lower molds 42 and stops suction the second semi-finished product 102. Thereafter, the second upper mold 31 is moved back to a predetermined position of the second pre-compression forming stage 30.

In the compression thermo-forming stage 40, the second semi-finished product 102 is thermo-compressed by and between the third upper mold 41 and the third lower mold 42. Namely, the third upper mold 41 is moved downward in a matching manner close to the third lower mold 42 for compressing the second semi-finished product 102 disposed therebetween. Besides. The wet pulp molding machine 1 further comprises at least one heater 43 (such as a heating plate/pipe), which is attached or disposed to either the third upper mold 41 or the third lower mold 42, for respectively heating the corresponding molds to accumulatedly dry the second semi-finished product 102 located thereon. Thus, the second semi-finished product 102 is thermo-compressed and shaped by and between the third upper mold 41 and the third lower mold 42 to form a third semi-finished product 103.

In the compression thermo-forming stage 40, a temperature of the heater 43 is controlled in a range of 100° C. to 180° C., and if the third lower mold 42 is made of aluminum, 120° C. is optimal but is not limited thereto. In different embodiment of the present invention, if the third lower mold 42 is a sintered copper mold, the temperature of the heater 43 is controlled in a range of 160° C. to 180° C. When the third upper mold 41 is moved downward in a matching manner close to the third lower mold 42, a second molding gap formed between the third upper mold 41 and the third lower mold 42 is less than or equal to 2 mm, 1.2 mm is preferably, and the third molding gap is less than the first molding gap. A dryness of the third semi-finished product 103 is in 92%.

For the same structure as the second upper mold 31 and the second lower mold 32 mentioned above, referring to FIG. 3-1 and FIG. 3-2, the third upper mold 41 and the third lower mold 42 comprise at least one through hole 44, respectively, for releasing out water or vapor from the second semi-finished product 102. The through holes 44 are distributed over inner surfaces of the third upper mold 41 and the third lower mold 42, through the third upper mold 41 and the third lower mold 42, respectively. Thus, the water or vapor drained off from the wet pulp can be released out via the through holes 44. Besides, the vacuum suctioning device 60 is respectively liquid-communicated with the respective through holes 44 of the third upper mold 41 and the third lower mold 42, for respectively drawing out the water or vapor.

The through holes are formed on the corresponding mold by at least one machining process, including, for example, a wire-cutting, a laser machining, a grinding, an electrical discharge machining processes and so on. In different embodiments of the present invention, the through holes 44 are formed integrally with the corresponding mold by a metallic casting/sintering process.

Figures 1, 3:
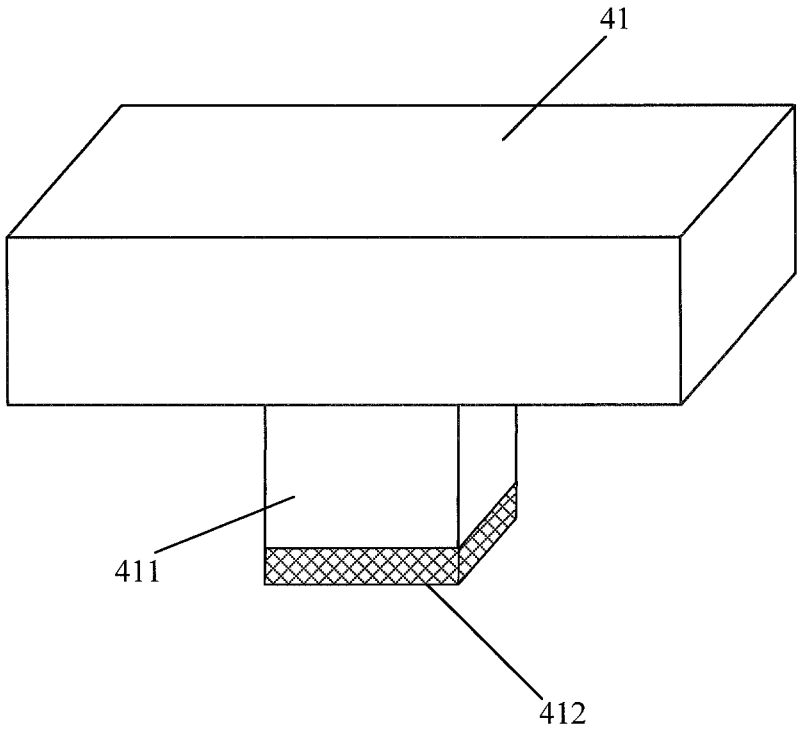
Figures 2, 3:
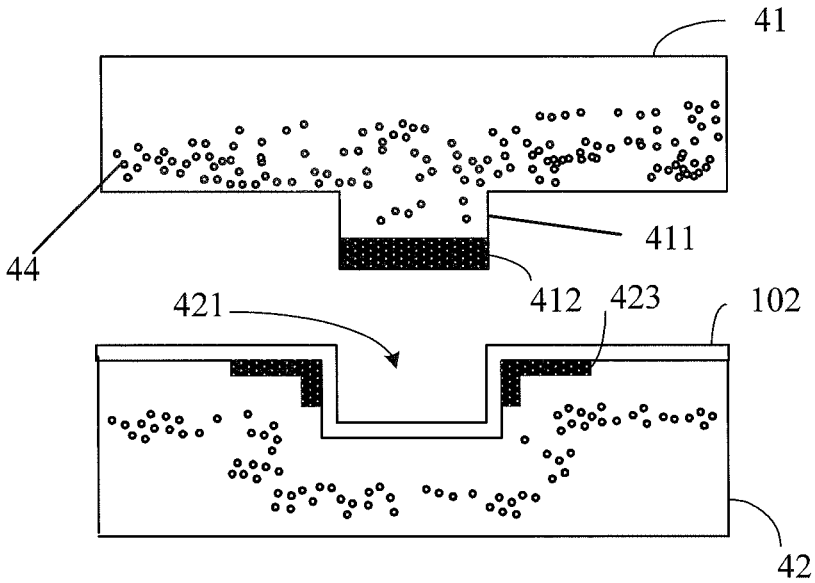

In the embodiment of the present invention, referring to FIG. 3-1 and FIG. 3-2, the third upper mold 41 and the third lower mold 42 are made of aluminum/any other metal having a higher smoothness on its molding surface. The third upper mold 41 is a convex shaped mold. Namely, a protrusion portion 411 is formed on a central portion of the third upper mold 41. The third lower mold 42 is a concave shaped mold structurally corresponding to the second upper mold 41. Namely, a groove 421 is formed on a central portion of the third lower mold 42. The third upper mold 41 further comprises a third upper mesh 412 disposed on a surface at an end of the protrusion portion of the third upper mold 41, and the third lower mold 42 further comprises a third lower mesh 423 disposed on a bottom of the groove 421 of the third lower mold 42, except that side edges of the bottom of the groove 421 are formed with smooth surfaces. The third lower mesh 423 is a double layered mesh structure which comprises a third inner lower mesh and a third outer upper mesh. A mesh count of the third outer upper mesh is greater than a mesh count of the third inner lower mesh. Thus, a space between the second semi-finished product 102 and the third lower mold 42 is broadened for increasing the efficiency of suctioning out the water or vapor from the second semi-finished product 102 and further for holding the second semi-finished product 102 on the third lower mesh. Meanwhile, as the vacuum suctioning device 60 draws out the water or vapor contained in the second semi-finished product 102, through the through holes 44, the second semi-finished product 102 can be held on the third lower mold 42 to avoid the second semi-finished product 102 from being inhaled into and blocking the through holes 44, and to prevent the second semi-finished product 102 from attaching to the third lower mold 42 upon mold stripping.

In this embodiment, the third upper mold 41 is made of aluminum, the third lower mold 42 is made of a porous metal material/alloy selected from the group consisting of sintered cooper, stainless steel and nickel alloy. Preferably, the third lower mold 42 is a sintered copper mold which is constructed by a plurality of cooper particles, the particles of the sintered cooper has an average diameter of 2~20 μm. Also, the third lower mold 42 can be a sintered copper mold having a porosity of the porous metal material 10%-25%. Since the third lower mold 42 utilizes the property of the porous metal material to inherently form a plurality of pores through the third lower mold 42, the third lower mold 42 can eliminate use of the third lower mesh 423 described in the previous embodiment.

Thereafter, the third upper mold 41 is moved by the third driving device 48 from the compression thermo-forming stage 40 to the edge-cutting stage 50, accompanying with conveying the third semi-finished product 103 which is being suctioned by the third upper mold 41. The edge-cutting stage 50 comprising a chopper 51 for cutting superfluous edges of the third semi-finished product 103 to form a finished product 104.

Besides, the first driving device 28, the second driving device 38 and the third driving device 48 is disposed on an upper side of the machine frame body 10. The machine frame body 10 is fitted with two parallel extending guide rails.

Figure 4:
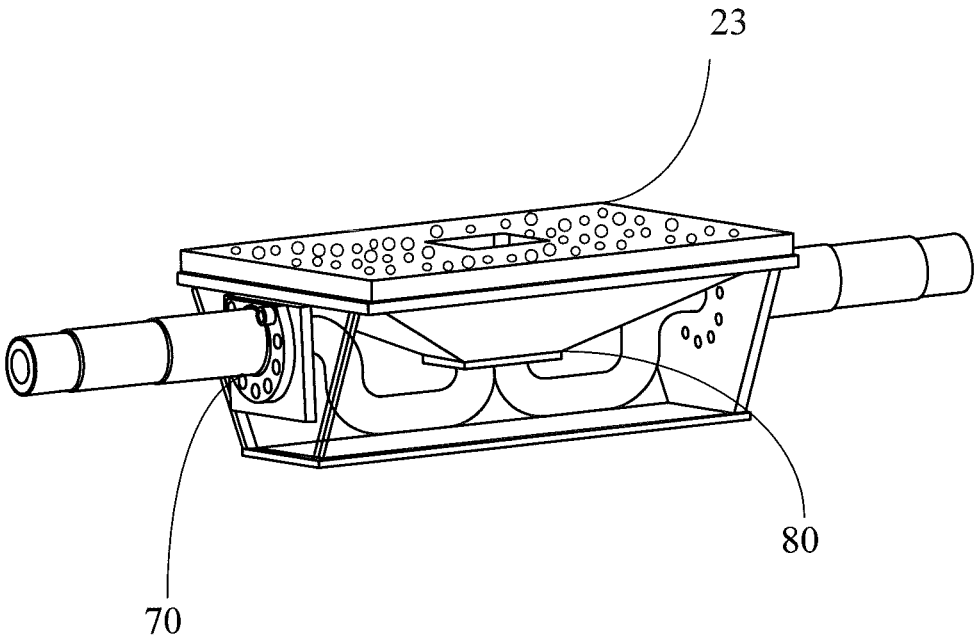
FIG. 4 depicts a schematically stereographic view of a reversible pulp-dredging device of the pulp molding machine according to a preferred embodiment of the present invention.
Figure 5:
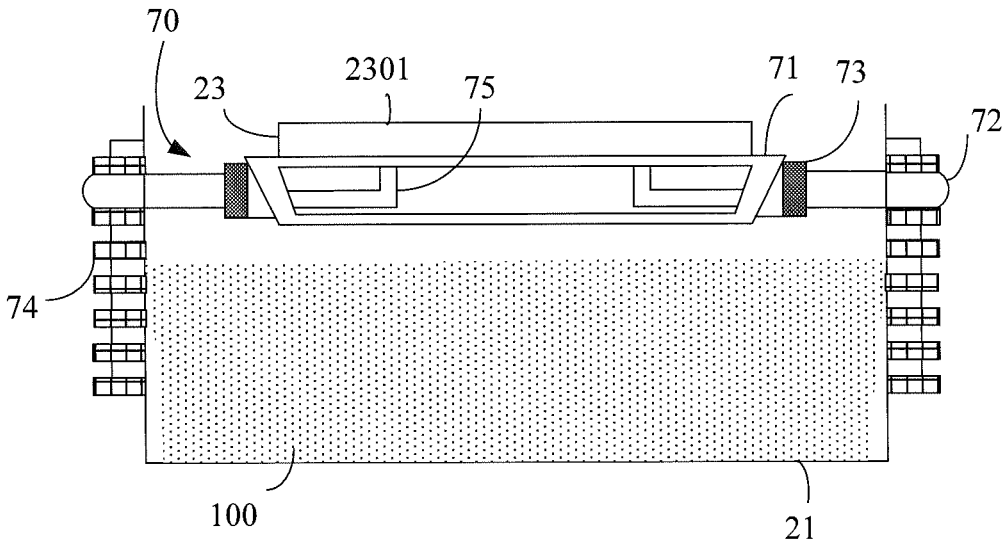
FIG. 5 depicts a cross-sectional view of the reversible pulp-dredging device disposed to the first lower mold according to a preferred embodiment of the present invention.

In addition, referring to FIGS. 4-5, in different embodiment of the present invention, the pulp molding machine 1 further comprises a reversible pulp-dredging device 70 disposed to the first lower mold 23. The reversible pulp-dredging device 70 comprises an inversion frame 71, a rotating shaft 72, an inversion driving element 73 and a pair of elevating elements 74. The first lower mold 23 is disposed to the inversion frame 71. The pair of elevating elements 74 is respectively installed onto both sidewalls of the paper slurry tank 21 for driving the inversion frame 71 with the first lower mold 23 dipping into the paper slurry 100 or resurfacing from the paper slurry 100. One end of a rotation axis of the rotating shaft 72 is configured with the elevating elements 74, and another end of the rotating shaft 72 is penetrated into the first lower mold 23. The inversion driving element 73 is disposed to the inversion frame 71 for driving the first lower mold 23 to rotate 180 degrees. The rotating shaft 72 is driven and rotated by the inversion driving element 71, and meanwhile the first lower mold 23 is driven by the rotating shaft 72 to rotate 180 degrees, thereby a surface 2301 of the first lower mold 23 is downwardly for dredging/collecting the paper slurry 100 from the paper slurry tank 21 or the surface 2301 of the first lower, mold 23 is upwardly for suctioning/absorbing the paper slurry 100 from the paper slurry tank 21. Accordingly, the pulp molding machine 1 further comprises a drawing element 80 disposed to the first lower mold 23, for suctioning/absorbing the wet pulp from the paper slurry tank 21 after the first lower mold 23 rotates in 180 degrees, so that the wet pulp is absorbed and attached on the surface 2301 of the first lower mold 23.

Therefore, there are two different operation modes for performing the process that the pulp molding machine 1 dredges/collects the paper slurry 100 from the paper slurry tank 21. The first operation mode is collecting/dredging up the paper slurry 100 from the paper slurry tank 21 for forming the wet pulp (i.e. the surface 2301 of the first lower mold 23 faces upwardly for collecting/dredging up the paper slurry 100 from the paper slurry tank 21). Another operation mode is that the first lower mold 23 is driven by the reversible pulp-dredging device 70 to rotate 180 degrees so that the surface 2301 of the first lower mold 23 faces downwardly for suctioning/absorbing the paper slurry 100 from the paper slurry tank 21.

The difference between the first operation mode of suctioning/absorbing the slurry 100 and the second operation mode of collecting/dredging up the slurry 100 is as follows. The fibers of the paper slurry 100 deposited in the bottom of the first lower mold 23 present different deposition situations. For example, in the suctioning/absorbing operation mode, the fibers of the paper slurry 100 nearby the first mesh 231 will be relatively short due to the suction effect. That is, the shorter fibers of the slurry 100 will be absorbed and deposited in the bottom of the first lower mold 23 after the first lower mold 23 rotates 180 degrees (an upper surface of the first lower mold 23 facing downward). Also, the longer fibers of the slurry 100 will be deposited away from the bottom of the first lower mold 23. Thus, each corner of the paper-shaped finished article 104 presents a finer rectangular status. With respect to the collecting/dredging operation, the fibers of the paper slurry 100 deposited in the bottom of the first lower mold 23 is only forced by the gravity. The longer fibers of the slurry 100 will be deposited in the bottom of the first lower mold 23. That result in each corner of the paper-shaped article 104 presents an obtuse state, such as unsightly corners or rounded corners.

Figure 6:
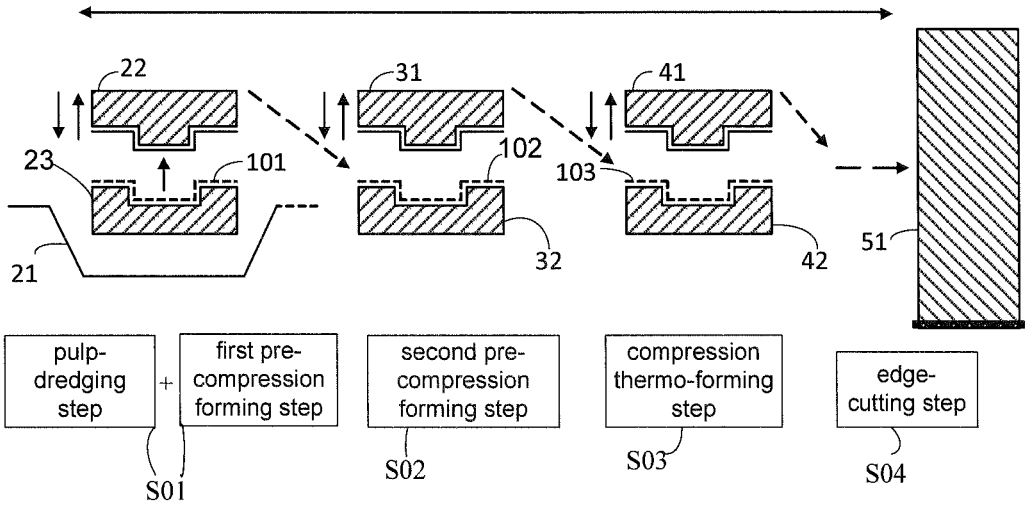
FIG. 6 depicts a flowchart of a pulp molding process according to a preferred embodiment of the present invention, which includes a pulp-dredging step, a first pre-compression forming step, a second pre-compression step, a compression thermo-forming step, and an edge-cutting step of the pulp molding process, for forming a paper-shaped article.

Further referring to FIG. 6, a flowchart of a pulp molding process with operation of the pulp molding machine in FIGS. 1-3, according to a preferred embodiment of the present invention is shown herein and, comprises the following steps.

In a step S01, a pulp-dredging step corresponding to the pulp-dredging stage, which is applied to collect/dredge up the paper slurry from the paper slurry tank and including a first pre-compression forming step which is further applied on the dredged wet pulp by and between the first upper mold and the first lower mold, both kept in a first molding gap therebetween, so as to form a first semi-finished product, wherein a dryness of the first semi-finished product is about 10%-50%. A cycle time of preforming the pulp-dredging step and the first pre-compression forming step is less than 10 seconds.

Besides, the first lower mold is sunk downwardly into the paper slurry tank to collect/dredge up the slurry above the first lower mold by the first driving device (i.e. a feeding shaft) disposed to the pulp-dredging stage. The first lower mold is moved upward by the first driving device to a predetermined position, and then the first upper mold is moved downward by a first vertical rack of the machine frame body in a matching manner close to the first lower mold, accompanying with performing the first pre-compression forming step where the first upper mold downwardly applies a first compressing force on the dredged wet pulp by and between the first upper mold and the first lower mold, both kept in the first molding gap therebetween. The first molding gap is in a range between 1 mm~5 mm, such as 3 mm is preferable.

After performing the first pre-compression forming step, water/vapor is drew out of the wet pulp inside the first lower mold and the wet pulp is sucked to the first upper mold by the suctioning device, so as to form the first semi-finished product.

The first upper mold is moved upward to an initial position of the pulp-dredging stage and is horizontally conveyed the first upper mold by a first horizontal sliding rack of the machine frame body, from the first pre-compression forming stage of the pulp-dredging stage, accompanying with conveying the first semi-finished product which is being suctioned by the first upper mold, to a second pre-compression forming step.

The first upper mold is moved downward to the determined position to place the first semi-finished product over the second lower mold. The first upper mold is moved back to the pulp-dredging stage.

In a step S02, the second pre-compression forming step applied on the first semi-finished product which is compressed by and between a second upper mold and a second lower mold of the pulp molding machine, so as to form a second semi-finished product.

In the step S02, the first semi-finished product is thermo-compressed by and between the second upper mold and the second lower mold. The second pre-compression forming step further comprises a heating sub-step applied to the first semi-finished product. The heating sub-step comprises applying at least one heater (such as a heating plate/pipe), which is attached or disposed to either the second upper mold or the second lower mold, for respectively heating the corresponding molds to accumulatedly dry the first semi-finished product located thereon. Thus, the first semi-finished product is thermo-compressed and shaped by and between the second upper mold and the second lower mold to form a second semi-finished product. In the step S02, a temperature of the heater is controlled in a range of 60° C. to 80°, and 70° C. is optimal but is not limited thereto. When the second upper mold is moved downward in a matching manner close to the second lower mold, a second molding gap formed between the second upper mold and the second lower mold is less than or equal to 2 mm, 1.2 mm is preferably, and the second molding gap is less than the first molding gap. A dryness of the second semi-finished product is in 58%-70%.

In a step S03, a compression thermo-forming step corresponding to the compression thermo-forming stage, which is further applied on the second semi-finished product by and between the third upper mold and the third lower mold, both kept in a third molding gap therebetween and less than the first molding gap, so as to form a third semi-finished product.

Thereafter, the third upper mold is moved downwardly in a matching manner close to the third lower mold, accompanying with applying a third compressing force on the second semi-finished product by and between the third upper mold and the third lower mold, both kept in the third molding gap therebetween and less than the first molding gap. In this embodiment of the present invention, the third molding gap is about 0~2 mm. A compression thermo-forming time of the second semi-finished compressed and heated between the third upper mold and the third lower mold is about 10 seconds.

In the step S03, the second semi-finished product located above the third lower mold is heated by the heater, and the heater draws the water/vapor out from the second semi-finished product between the third upper and third lower molds, so as to form the third semi-finished product. A heating time of the step S03 is 10 seconds with a heating temperature between 100~180° C., and 120° C. is preferable. At this time, a dryness of the second semi-finished product is 92%.

The third upper mold is moved upward by a third driving device (such as a vertical sliding rack) of the machine frame body to the initial position of the compression thermo-forming step and then, the third upper mold is horizontally conveyed with the third semi-finished product to the edge-cutting stage by the third driving device (such as a second horizontal sliding rack) of the machine frame body. The cycle time of step S03 is between 30-50 seconds.

In a step S04, an edge-cutting step corresponding to the edge-cutting stage, which is further applied on the third semi-finished product by a chopper to form the paper-shaped article.

In the step S04, a mechanical chopper or a laser cutter is used to cut edges of the third semi-finished product so as to form the paper-shaped article as a paper shaped product (i.e. a 3C product box).

Figure 7:
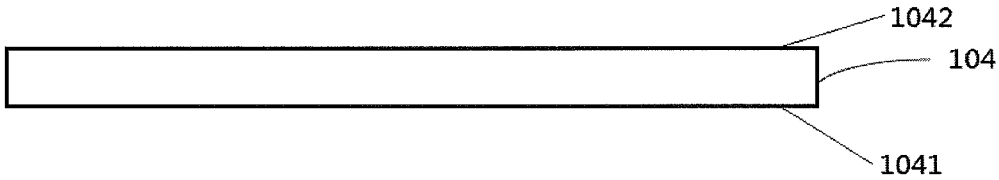
FIG. 7 depicts a cross-sectional view of a paper-shaped article made by the pulp molding machine and the pulp molding process according to a preferred embodiment of the present invention.

Refer to FIG. 7, which is a cross-sectional view of a paper-shaped article made by the pulp molding machine and the pulp molding process according to a preferred embodiment of the present invention. The paper-shaped article 104 comprises a smooth inner surface 1041 and a smooth outer surface 1042. Both the smooth inner surface 1041 and the smooth outer surface 1042 have a surface smoothness of greater than 3 seconds according to Bekk Smoothness measurement, and 6-14 seconds according to Bekk Smoothness measurement is preferable.

Figure 8:
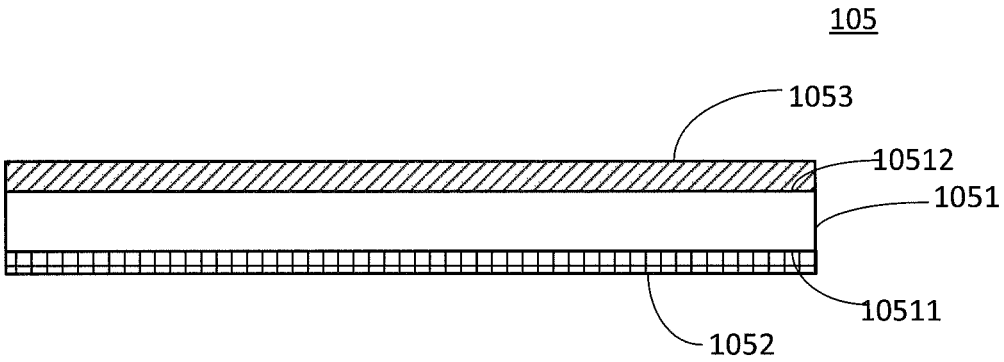
FIG. 8 depicts a cross-sectional view of a paper-shaped article made by the pulp molding machine and the pulp molding process according to another preferred embodiment of the present invention.

Refer to FIG. 8, which is a cross-sectional view of a paper-shaped article made by the pulp molding machine and the pulp molding process according to another preferred embodiment of the present invention. The paper-shaped article 105 comprises a middle fiber layer 1051, a smooth inner layer 1052 formed on one surface 10511 of the middle fiber layer 1051, which has a surface smoothness greater than or equal to 3 seconds according to Bekk Smoothness measurement, and 6-14 seconds according to Bekk Smoothness measurement is preferable. A smooth outer layer 1053 formed on another surface 10512 of the middle fiber layer 1051, which has a surface smoothness greater than or equal to 3 seconds according to Bekk Smoothness measurement, and 6-14 seconds according to Bekk Smoothness measurement is preferable. Besides, the middle fiber layer 1051 has a lower smoothness than either the outer layer 1053 or the inner layer 1052.

In this embodiment, the middle fiber layer 1051 is made of different composite from the composite of either of the outer layer 1053 and the inner layer 1052. The composite of which the middle fiber layer 1051 is made contains fibers that are longer than the fibers contained in the composite of either of the outer layer 1053 and the inner layer 1052 in length.

Furthermore, the outer layer 1053 and the inner layer 1052 have different smoothness from each other based on the different composites thereof, or have the same smoothness based on the same composites thereof.

The present invention has disclosed that the pulp molding machine, the pulp molding process and the paper-shaped article made by the pulp molding machine and the pulp molding process and are able to solve the problems of lower production efficiency in mass caused by the time consuming of the thermo-forming step and the pulp molding article being crushed easily. For solving the problems mentioned above, the pulp molding machine applies the first pre-compression forming sub-process on the dredged wet pulp by and between the first upper mold and the first lower mold for suctioning out the water/vapor contained in the wet pulp. That can reduce the water or vapor content in the wet pulp before performing a second pre-compression stage and a compression thermo-forming stage for preventing the crushing of the structure of the pulp molding article during the compression thermo-forming stage if a larger compression force and thermal is applied on the wet pulp rapidly. Thus, pulp fibers within the wet pulp become denser, and then the water or vapor content in the wet pulp is suctioned out before performing a second pre-compression stage and a compression thermo-forming stage, thereby shortening the production time of the following stages and improving the production efficiency in mass.

The present invention has been described with preferred embodiments thereof, and it is understood that many changes and modifications to the described embodiments can be carried out without departing from the scope and the spirit of the invention that is intended to be limited only by the appended claims.

What is claimed is:

1. A pulp molding machine, comprising:

a machine frame body;

a pulp-dredging stage disposed on the machine frame body, comprising a paper slurry tank, a first upper mold, a first lower mold and a first driving device, wherein a wet pulp is dredged up by the first lower mold from the paper slurry tank, and then the dredged wet pulp is applied a first pre-compression sub-stage by and between the first upper mold and the first lower mold, to form a first semi-finished product;

a second pre-compression stage disposed, adjacent to the pulp-dredging stage, on the machine frame body, comprising a second upper mold, a second lower mold and a second driving device, wherein the first upper mold is moved by the first driving device from the first pre-compression sub-stage of the pulp-dredging stage to the second pre-compression stage, accompanying with conveying the first semi-finished product to the second pre-compression stage, the first semi-finished product is compressed by and between the second upper mold and the second lower mold, to form a second semi-finished product;

a compression thermo-forming stage disposed, adjacent to the second pre-compression stage, on the machine frame body, comprising a third upper mold, a third lower mold and a third driving device, wherein the second upper mold is moved by the second driving device from the second pre-compression stage to the compression thermo-forming stage, accompanying with conveying the second semi-finished product to the compression thermo-forming stage, the second semi-finished product is thermo-compressed by and between the third upper mold and the third lower mold, to form a third semi-finished product; and an edge-cutting stage comprising a chopper, and disposed on the machine frame body, adjacent to the compression thermo-forming stage, wherein the third upper mold is moved by the third driving device from the compression thermo-forming stage to the edge-cutting stage, accompanying with conveying the third semi-finished product to the edge-cutting stage, the edge-cutting stage make the chopper cutting superfluous edges of the second semi-finished product to form a finished product;

wherein a protrusion portion is on a central portion of the third upper mold, a groove is positioned on a central portion of the third lower mold, the third upper mold further comprises a third upper mesh disposed under a bottom of the protrusion portion of the third upper mold, and the third lower mold further comprises a third lower mesh disposed on a top edge of the groove of the third lower mold.

2. The pulp molding machine according to claim 1, wherein when the first upper mold is moved downward in a matching manner close to the first lower mold, a first molding gap formed between the first upper mold and the first lower mold is in a range between 1 mm-5 mm.

3. The pulp molding machine according to claim 2, wherein when the second upper mold is moved downward in a matching manner close to the second lower mold, a second molding gap formed between the second upper mold and the second lower mold is less than or equal to 2 mm, and the second molding gap is less than the first molding gap.

4. The pulp molding machine according to claim 2, wherein when the third upper mold is moved downward in a matching manner close to the third lower mold, a third molding gap formed between the third upper mold and the third lower mold is less than or equal to 2 mm, and the third molding gap is less than the first molding gap.

5. The pulp molding machine according to claim 1, wherein the first upper mold, the second upper mold and the third upper mold are convex shaped molds, and the first lower mold, the second lower mold and the third lower mold are concave shaped molds.

6. The pulp molding machine according to claim 1, wherein the first upper mold, the first lower mold, the second upper mold, the second lower mold, the third upper mold and the third lower mold are formed with at least one through hole respectively therein, for respectively releasing out water or vapor from the dredged wet pulp, the first semi-finished product, the second semi-finished product and the third semi-finished product on the corresponding molds.

7. The pulp molding machine according to claim 6, wherein the pulp molding machine further comprises a suctioning device liquid-communicated with the through holes within the first upper mold, the first lower mold, the second upper mold, the second lower mold, the third upper mold and the third lower mold for drawing out the water or vapor.

8. The pulp molding machine according to claim 1, wherein the pulp molding machine further comprises at least one heater, the heater is disposed to either the second upper mold and the third upper mold or the second lower mold and the third lower mold, for respectively heating the corresponding molds to accumulatedly dry the first semi-finished product and the third semi-finished product thereon.

9. The pulp molding machine according to claim 1, wherein the first upper mold and the first lower mold are made of aluminum, the first lower mold further comprises a double layered first mesh disposed on an inner surface thereof for holding the wet pulp on the first mesh, and the first mesh comprises a first inner mesh and a first outer mesh, a mesh count of the first outer mesh is greater than a mesh count of the first outer mesh.

10. The pulp molding machine according to claim 1, wherein the second lower mold is made of a porous metal material selected from the group consisting of sintered copper, stainless steel, and nickel alloy, and the second upper mold is made of aluminum, and a porosity of the porous metal material is 10%-25%.

11. The pulp molding machine according to claim 1, wherein the third upper mold and the third lower mold are made of aluminum.

12. The pulp molding machine according to claim 1, wherein the third lower mold is made of a porous metal material selected from the group consisting of sintered copper, stainless steel, and nickel alloy, and the third upper mold is made of aluminum, and a porosity of the porous metal material is 10%-25%.

13. The pulp molding machine according to claim 1, wherein the pulp molding machine further comprises a reversible pulp-dredging device disposed to the first lower mold, for driving the first lower mold to rotate 180 degrees.

14. The pulp molding machine according to claim 13, wherein the pulp molding machine further comprises a drawing element disposed to the first lower mold for drawing and attaching the wet pulp on a surface of the first lower mold in the paper slurry tank after the first lower mold rotates in 180 degrees.

* * * * *